US011503871B2

(12) United States Patent
Moran

(10) Patent No.: US 11,503,871 B2
(45) Date of Patent: Nov. 22, 2022

(54) HEADWEAR ARTICLES THAT ARE SELECTIVELY CONVERTIBLE TO A MASK CONFIGURATION

(71) Applicant: Phillip Alexander Moran, Miami, FL (US)

(72) Inventor: Phillip Alexander Moran, Miami, FL (US)

( * ) Notice: Subject to any disclaimer, the term of this patent is extended or adjusted under 35 U.S.C. 154(b) by 0 days.

(21) Appl. No.: 17/500,225

(22) Filed: Oct. 13, 2021

(65) Prior Publication Data

US 2022/0110397 A1 Apr. 14, 2022

Related U.S. Application Data

(60) Provisional application No. 63/180,974, filed on Apr. 28, 2021, provisional application No. 63/091,016, filed on Oct. 13, 2020.

(51) Int. Cl.
*A42B 1/206* (2021.01)
*A41D 13/11* (2006.01)

(52) U.S. Cl.
CPC ..... *A42B 1/206* (2013.01); *A41D 13/1192* (2013.01)

(58) Field of Classification Search
CPC ..... A42B 1/206; A42B 1/006; A42B 1/201; A42B 1/22; A42B 3/08; A42B 1/045; A42B 1/0182; A41D 13/11; A41D 13/1192; A41D 13/1161; A41D 13/1107
USPC ..... 2/209.11, 209.12, 173; 128/863
See application file for complete search history.

(56) References Cited

U.S. PATENT DOCUMENTS 5,253,364 A * 10/1993 Robinson ..... A42B 1/0184 2/209.12
5,832,538 A 11/1998 Williams
2011/0232653 A1 9/2011 Imashiro et al.
2016/0073720 A1* 3/2016 Niedrich ..... A42B 1/0187 2/173
2020/0093212 A1* 3/2020 Zheng et al. ..... A42B 1/24
2021/0316173 A1* 10/2021 Elsherif ..... A41D 13/1107
2021/0339269 A1* 11/2021 Kuntz ..... A62B 7/10

FOREIGN PATENT DOCUMENTS

KR 20100012406 U * 12/2010
WO WO-2005000058 A1 * 1/2005 ..... A41D 13/1161

OTHER PUBLICATIONS

English Translation of KR-20100012406, Oh et al., Dec. 15, 2010.*
ISA Search Report and written opinion for PCT/US 21/54731 dated Jan 21, 2022.

* cited by examiner

*Primary Examiner* — Nathan E Durham
*Assistant Examiner* — Abby M Spatz
(74) *Attorney, Agent, or Firm* — Ballard Spahr LLP

(57) ABSTRACT

A headwear article that converts between a headwear configuration and a mask configuration. The headwear article has a crown for covering at least a portion of a head of a wearer, a visor attached to a front portion of the crown, and at least one mask support element coupled to the crown. From the headwear configuration, at least a portion of the rear portion of the crown is collapsible into the front portion of the crown to position the headwear in the mask configuration. In the mask configuration, the at least one mask support element is configured to secure the headwear over a portion of a face of the wearer.

12 Claims, 15 Drawing Sheets

HEADWEAR ARTICLES THAT ARE SELECTIVELY CONVERTIBLE TO A MASK CONFIGURATION

CROSS-REFERENCE TO RELATED APPLICATIONS

This application claims priority to and the benefit of the filing date of the following patent applications: U.S. Provisional Patent Application No. 63/091,016, filed Oct. 13, 2020; and U.S. Provisional Patent Application No. 63/180,974, filed Apr. 28, 2021. Each of these applications is incorporated herein by reference in its entirety.

FIELD

This application relates generally to articles of headwear (e.g., caps) that are selectively convertible from a headwear configuration to a mask configuration.

BACKGROUND

The COVID-19 Pandemic has made it necessary for most individuals to carry masks and other personal protective equipment anytime they leave their residence. However, it is challenging to keep up with the location of such masks at all times, and individuals are prone to inadvertently leave their masks at home. Further, even when individuals remember their masks, it is inconvenient to travel with masks in pockets, and it is difficult to repeatedly adjust the positioning of masks to complete various activities, such as eating or drinking. There is a need for products that address one or more of these deficiencies.

SUMMARY

Described herein, in various aspects, is an article of headwear that is convertible between a headwear configuration and a mask configuration. The headwear can comprise a crown for covering at least a portion of a head of a wearer, a visor, and at least one mask support element coupled to the crown. The crown can have a rear portion and a front portion that cooperate to define a circumference of the crown, and the visor can be attached to the front portion of the crown. From the headwear configuration, at least a portion of the rear portion of the crown can be collapsible into the front portion of the crown to position the headwear in the mask configuration. In the mask configuration, the at least one mask support element can be configured to secure the headwear over a portion of a face of the wearer.

Methods of using the disclosed headwear articles are also described.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

These and other features of the preferred embodiments of the invention will become more apparent in the detailed description in which reference is made to the appended drawings wherein.

DETAILED DESCRIPTION

Figure 1:
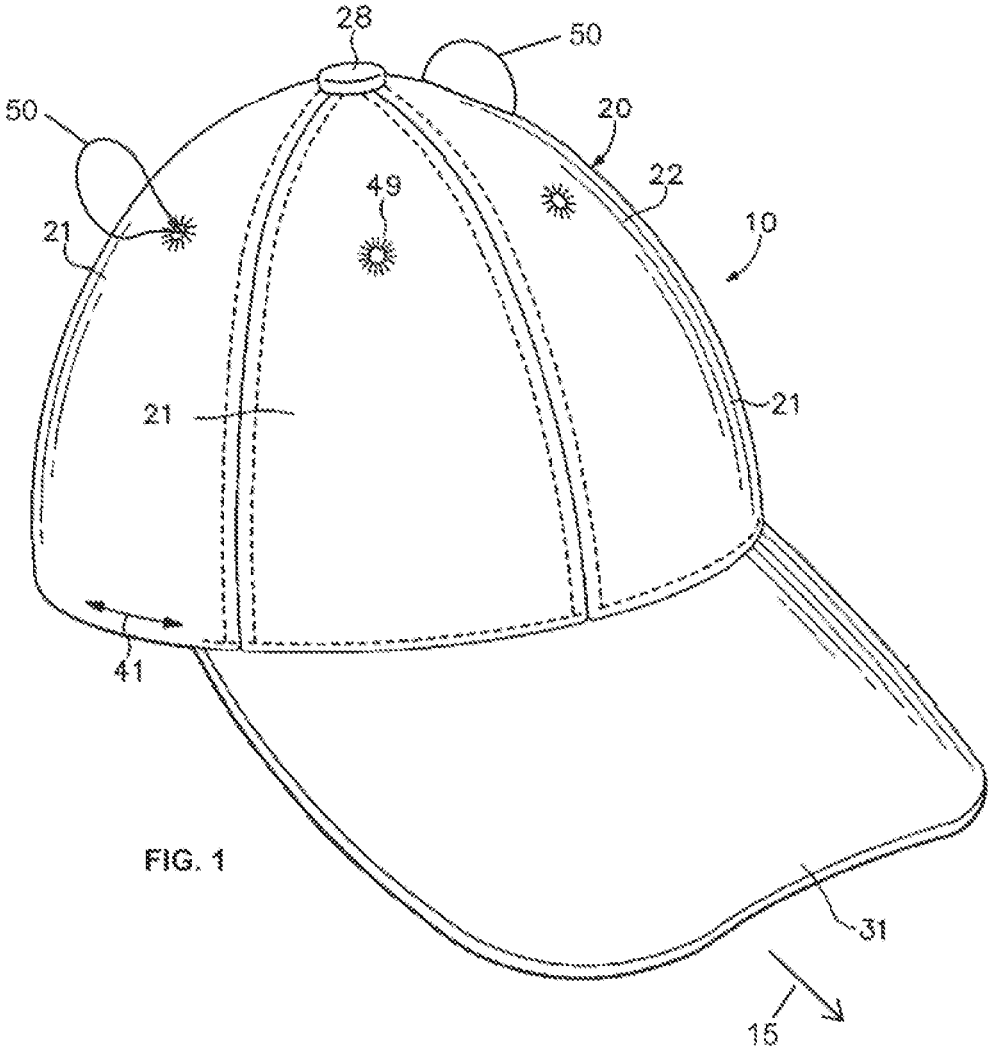
FIG. 1 is a front perspective view of an exemplary headwear article as disclosed herein.

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present invention which will be limited only by the appended claims.

It must be noted that as used herein and in the appended claims, the singular forms "a," "an," and "the" include plural references unless the context clearly dictates otherwise. Thus, for example, reference to "a support element" includes one or more of such support elements, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about." it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values are approximated by use of the antecedents "about," "substantially," "approximately," or "generally." it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

Figure 2:
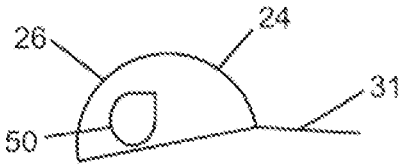
FIG. 2 is a schematic side view of an exemplary headwear article as disclosed herein, with the headwear article shown in a headwear configuration.
Figure 3A:
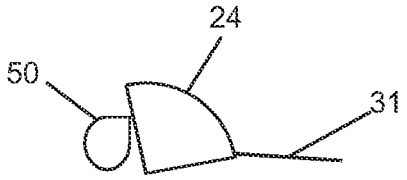
FIG. 3A is a schematic side view of the headwear article of FIG. 2, with the headwear article shown in a mask configuration.
Figure 3B:
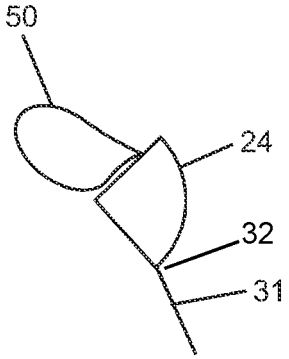
FIG. 3B is a schematic side view of the headwear article of FIG. 3A, with the headwear article positioned over the face of a wearer.
Figure 3C:
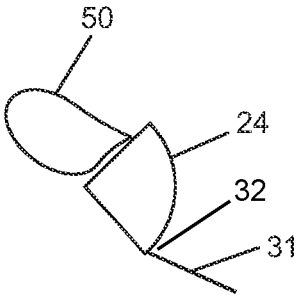
FIG. 3C is a schematic side view of the headwear article of FIG. 3B, showing pivoting of the visor relative to the position depicted in FIG. 31.
Figure 4:
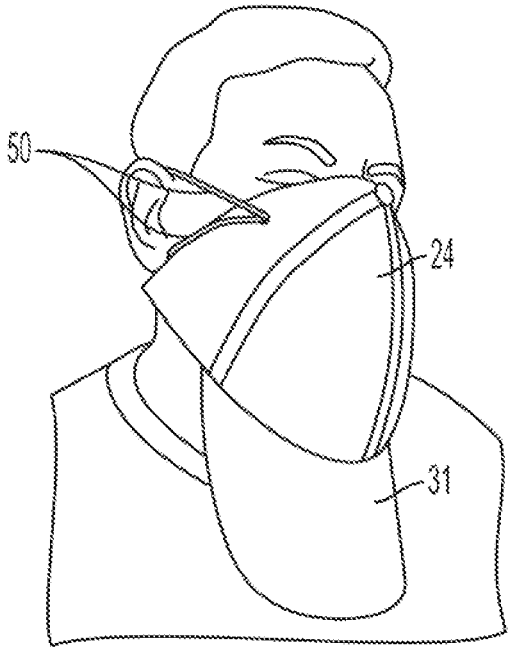
FIG. 4 depicts an exemplary headwear article (e.g., cap) having loops that extend from the crown of the headwear article to support the headwear article in the mask configuration over the face of the wearer.

In various aspects, and with reference to FIGS. 1-9C, disclosed herein is an article of headwear 10 that is convertible between a headwear configuration and a mask configuration. As shown the headwear 10 can optionally be provided in the form of a cap, such as a baseball cap. In one aspect, the headwear 10 can comprise a crown 20 for covering at least a portion of a head of a wearer. As shown in FIGS. 2-3C, the crown 20 can have a rear portion 26 and a front portion 24 that cooperate to define a circumference 41 of the crown. In another aspect, the headwear 10 can comprise a visor 31 attached to the front portion 24 of the crown 20. In exemplary aspects, the visor 31 can have a conventional visor board configuration, such as, for example, a visor with a semi-rigid polymer visor board sandwiched between textile elements.

In further aspects, it is contemplated that crown 20 can form a generally hemispherical covering for a head of a wearer, with the visor 31 extending outward in a generally horizontal direction from the crown 20 to shade the face and eyes of the wearer. Optionally, the materials forming crown 20 can extend entirely around a circumference of the head to provide headwear 10 with the appearance of a fitted baseball cap that accommodates an individual with specific head dimensions.

In exemplary aspects, the crown 20 can comprise a plurality of panels 21 that are attached together along abutting sides. Optionally, crown 20 can comprise six panels, such as, for example, two front panels, two side panels, and two rear panels. The various panels 21 can define an exterior surface 22 and an opposite interior surface (not shown). Optionally, in exemplary aspects, the crown 20 can further comprise a button 28 where the panels meet at the top of the crown. Optionally, in further exemplary aspects, the crown 20 can further comprise at least one aperture 49, with each aperture being formed in a respective panel 21 to improve the transfer of air through the crown.

In use, and with reference to FIGS. 2-3C, when starting from the headwear configuration (in which the headwear is positioned over, or configured for positioning over, the head of a wearer), at least a portion of the rear portion 26 of the crown 20 is collapsible into the front portion 24 of the crown to position the headwear in the mask configuration. In exemplary aspects, it is contemplated that the rear portion 26 can be displaced by applying force to the portion of the exterior surface 22 defined by the rear portion of the crown 20. In these aspects, it is contemplated that the force can be applied in the general direction of the front portion 24 of the crown 20 (or the visor 31), for example, relative to displacement axis 15 (FIG. 1). It is contemplated that the mechanical connection between the visor 31 and the front portion 24 of the crown 20 can provide sufficient structural support to the front portion 24 of the crown that the front portion of the crown will generally retain its shape while the rear portion 26 is folded inwardly and collapsed into the front portion. In use, it is contemplated that the force can be applied manually, by hand or by pressing the exterior surface of the rear portion of the headwear 10 against a portion of the body (e.g., head) of the wearer or another structure or surface. Optionally, the force can be applied while the wearer holds the visor (without directly holding the crown). Optionally, in exemplary aspects, the interior of the front portion 24 of the crown can comprise a fastener that is configured to engage a complementary fastener of the interior of the rear portion 26 of the crown to secure the crown in the mask configuration.

In contrast to conventional headwear (e.g., cap) designs, the disclosed headwear 10 can comprise at least one mask support element 50 coupled to the crown. When the headwear 10 is in the mask configuration, the at least one mask support element can be configured to secure the headwear over a portion of a face of the wearer.

Optionally, in exemplary aspects, and as shown in FIGS. 1-4, the at least one mask support element 50 can comprise a plurality of mask support elements, such as, for example, first and second mask support elements that are configured to engage portions of respective ears of the wearer. In some aspects, the plurality of mask support elements 50 can comprise first and second loops that extend outwardly from the crown that, in the mask configuration, are configured for placement over respective ears of the wearer. In these aspects, it is contemplated that the loops can comprise elastic material, such as for example, rubber, which can optionally be surrounded by padding or other soft material to improve user comfort. Optionally, it is contemplated that the first and second loops can extend through respective apertures 49 that are positioned on opposing right and left sides of the crown 20, with each loop being secured within the interior of the crown. Additionally, or alternatively, it is contemplated that one or more of the mask support elements 50 can be secured to the exterior surface 22 of the crown, for example, by sewing or by fastener (e.g., a snap attachment). More generally, it is contemplated that the mask support elements 50 can be coupled to the crown in any conventional manner that permits movement and/or adjustment of the mask support elements 50 as disclosed herein.

Figure 5:
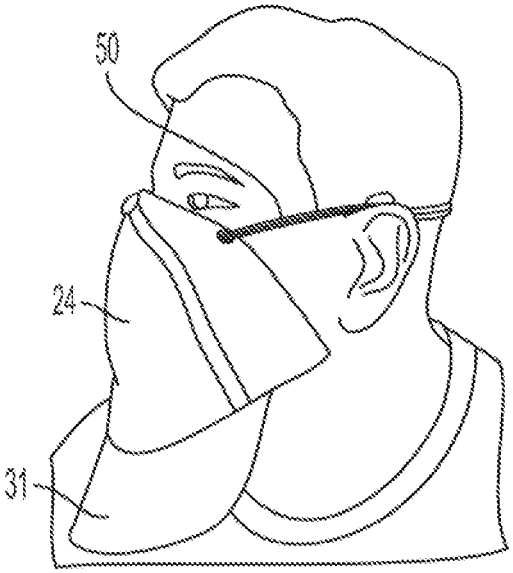
FIG. 5 depicts an exemplary headwear article (e.g., cap) having a band that extends from the crown of the headwear article to support the headwear article in the mask configuration over the face of the wearer.

Optionally, in exemplary aspects, and as shown in FIG. 5, the at least one mask support element 50 can comprise at least one band that forms a continuous loop that extends outwardly from and between opposing sides of the crown. In these aspects, it is contemplated that the band can comprise elastic material, such as for example, rubber, which can optionally be surrounded by padding or other soft material to improve user comfort. Optionally, it is contemplated that the band can extend through apertures 49 that are positioned on opposing right and left sides of the crown 20, with the band being secured within the interior of the crown. Alternatively, it is contemplated that the band can have ends that are secured to the exterior surface of the crown, for example, by sewing or by at least one fastener (e.g., a snap attachment). More generally, it is contemplated that the band can be coupled to the crown in any suitable fashion that permits movement and/or adjustment of the band as disclosed herein. In further aspects, rather than providing a band that forms a continuous loop, it is contemplated that the at least one mask support element can comprise two separate bands (extending from opposing sides of the crown) that can be selectively tied together to secure the crown against the face of the wearer.

Figure 6:
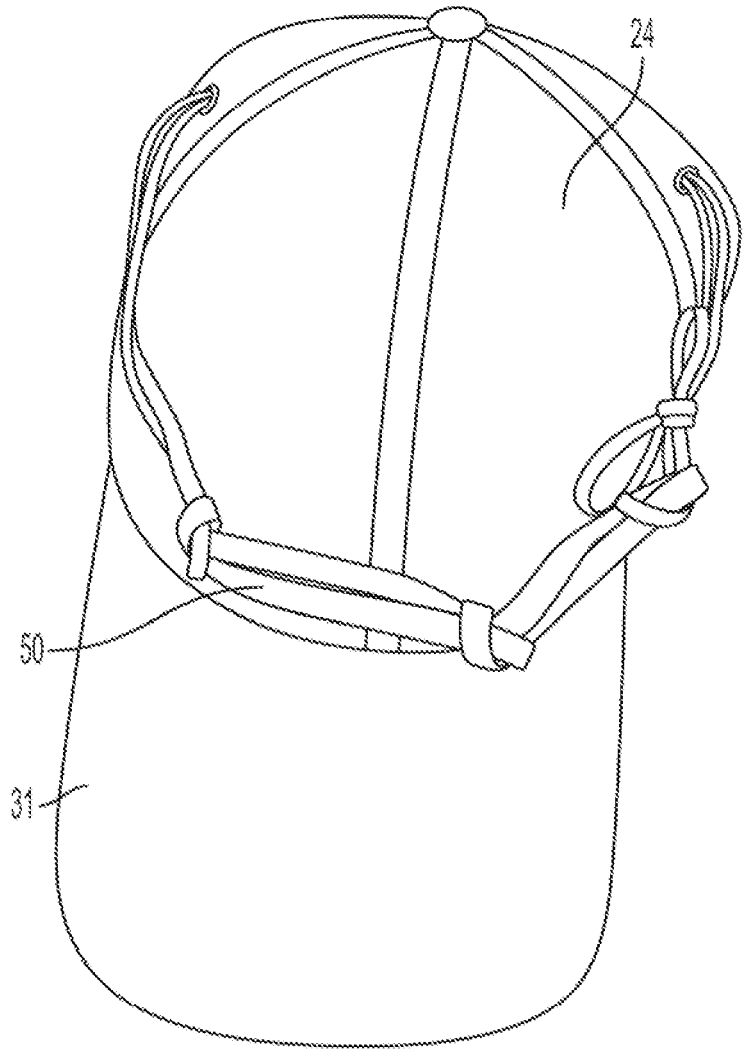
FIG. 6 depicts an exemplary mask support element in a stowed position as disclosed herein.
Figure 7A:
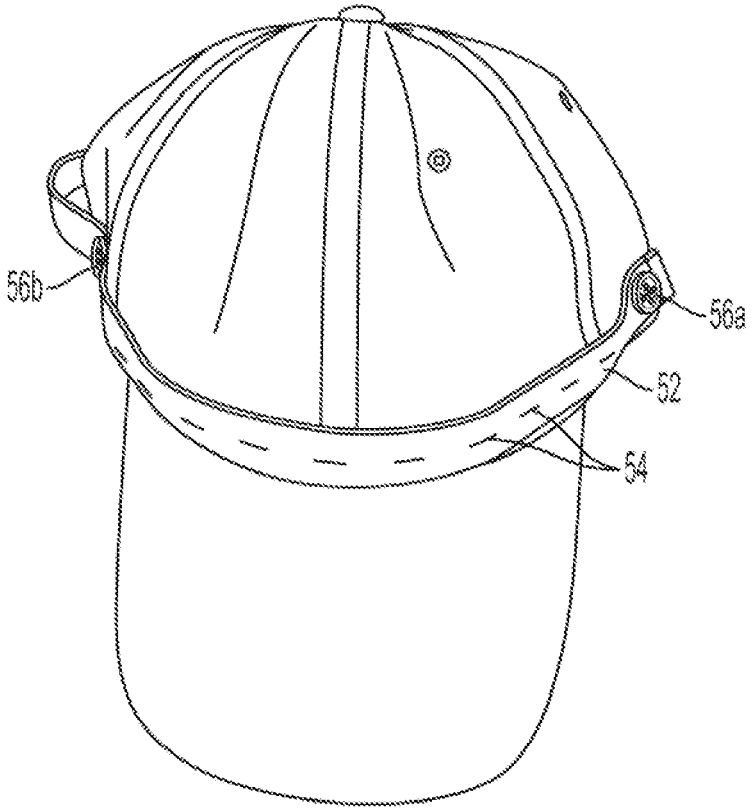
FIG. 7A depicts an exemplary mask support element in a stowed position as disclosed herein.
Figure 7B:
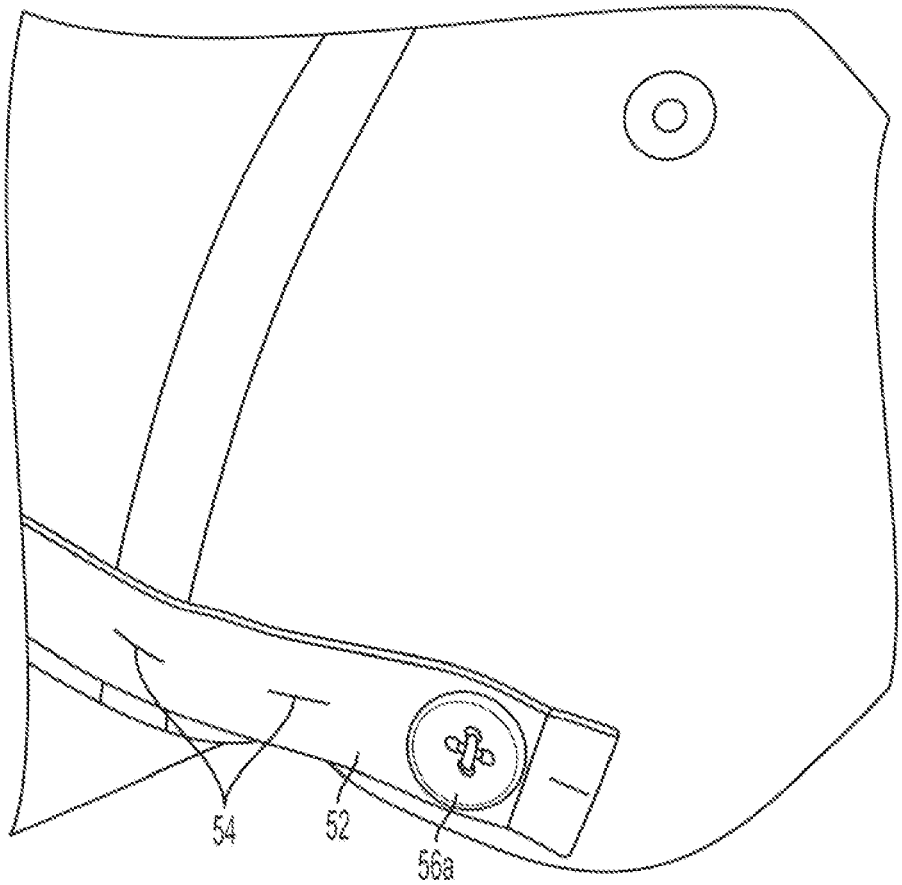
FIG. 7B is a close-up view depicting an exemplary fastener for coupling the mask support element of FIG. 7A to a headwear article as disclosed herein.
Figure 7C:
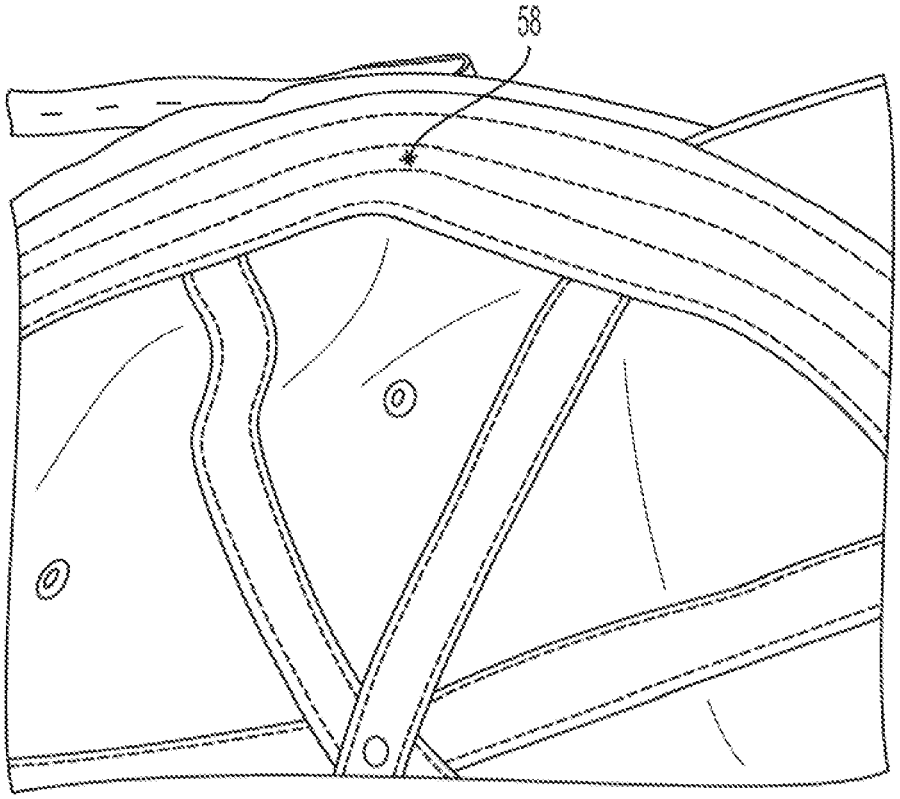
FIG. 7C is a close-up view depicting stitching that secures the fastener of FIG. 7B to the headwear article.
Figure 8A:
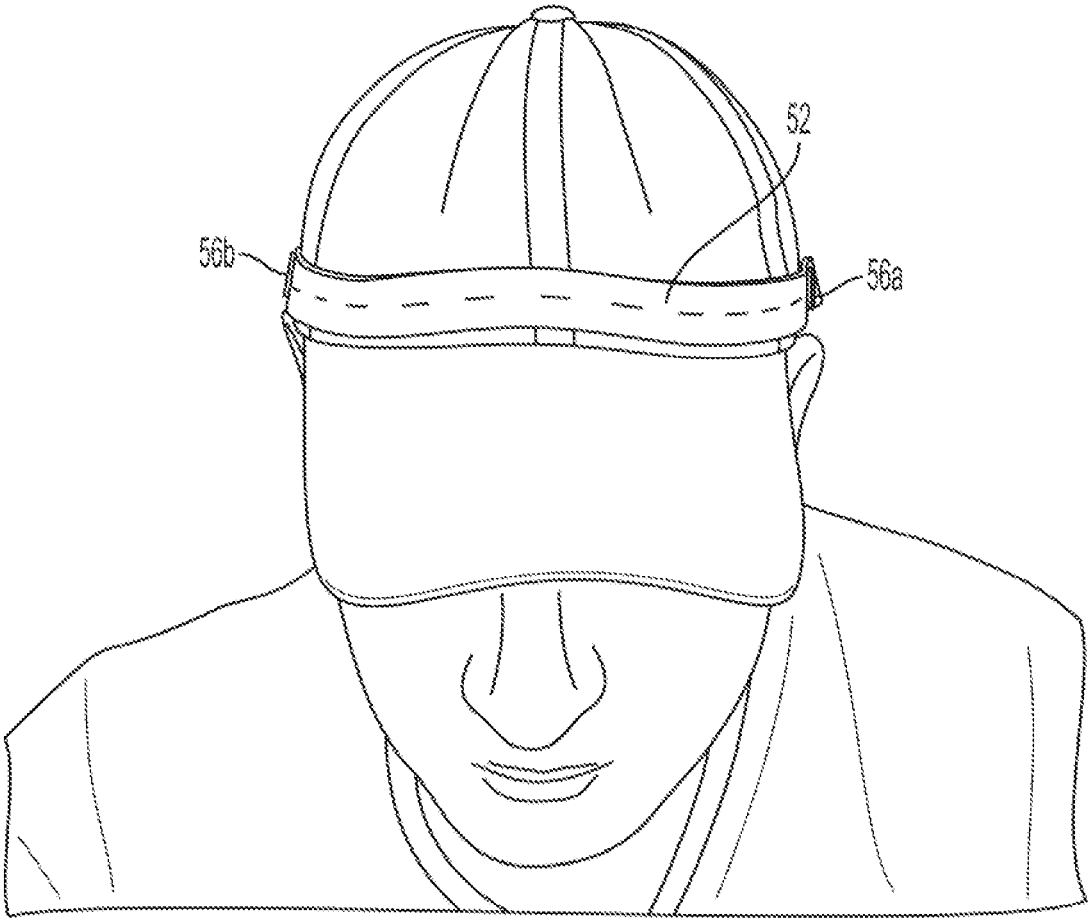
FIGS. 8A-8C are various views of a wearer using a headwear article (e.g., cap) with the mask support element of FIGS. 7A-7C in a stowed position.
Figure 8B:
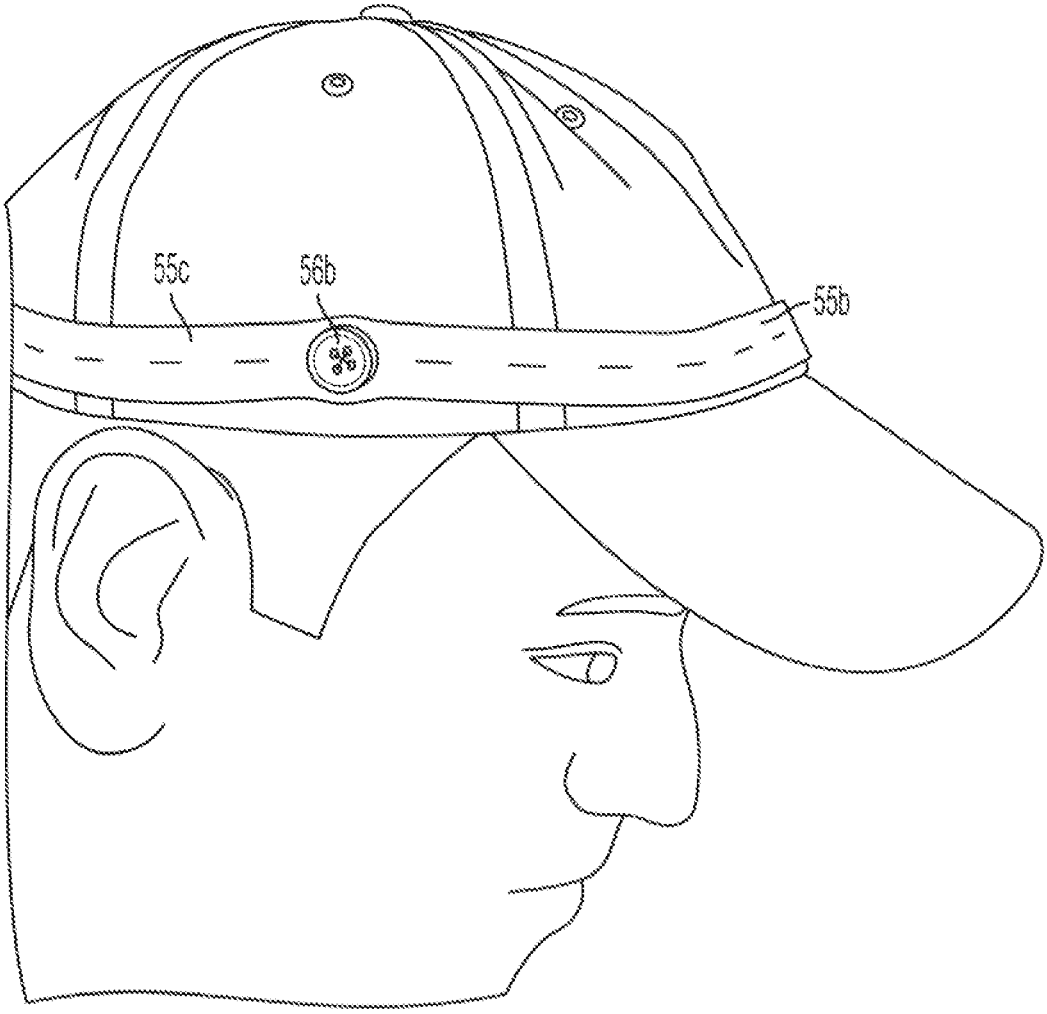
Figure 8C:
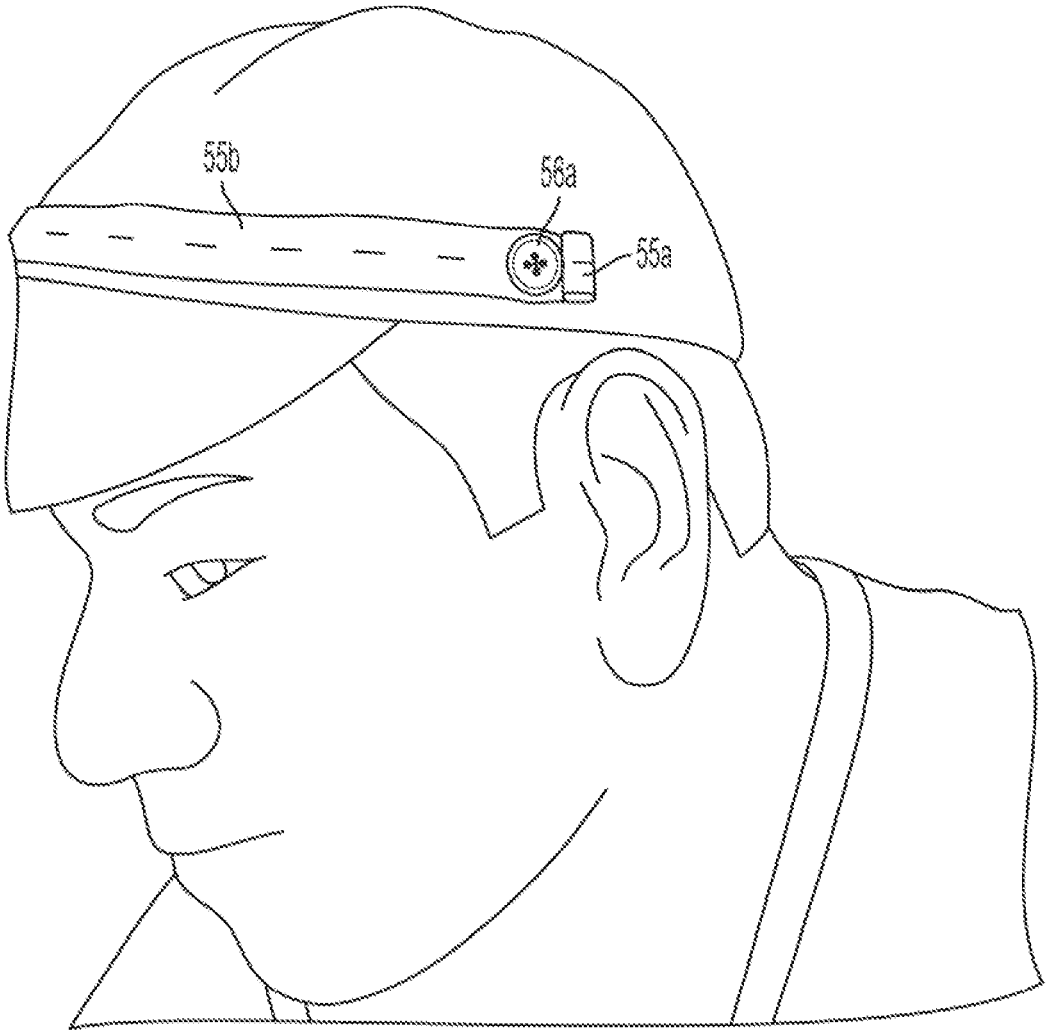
Figure 9A:
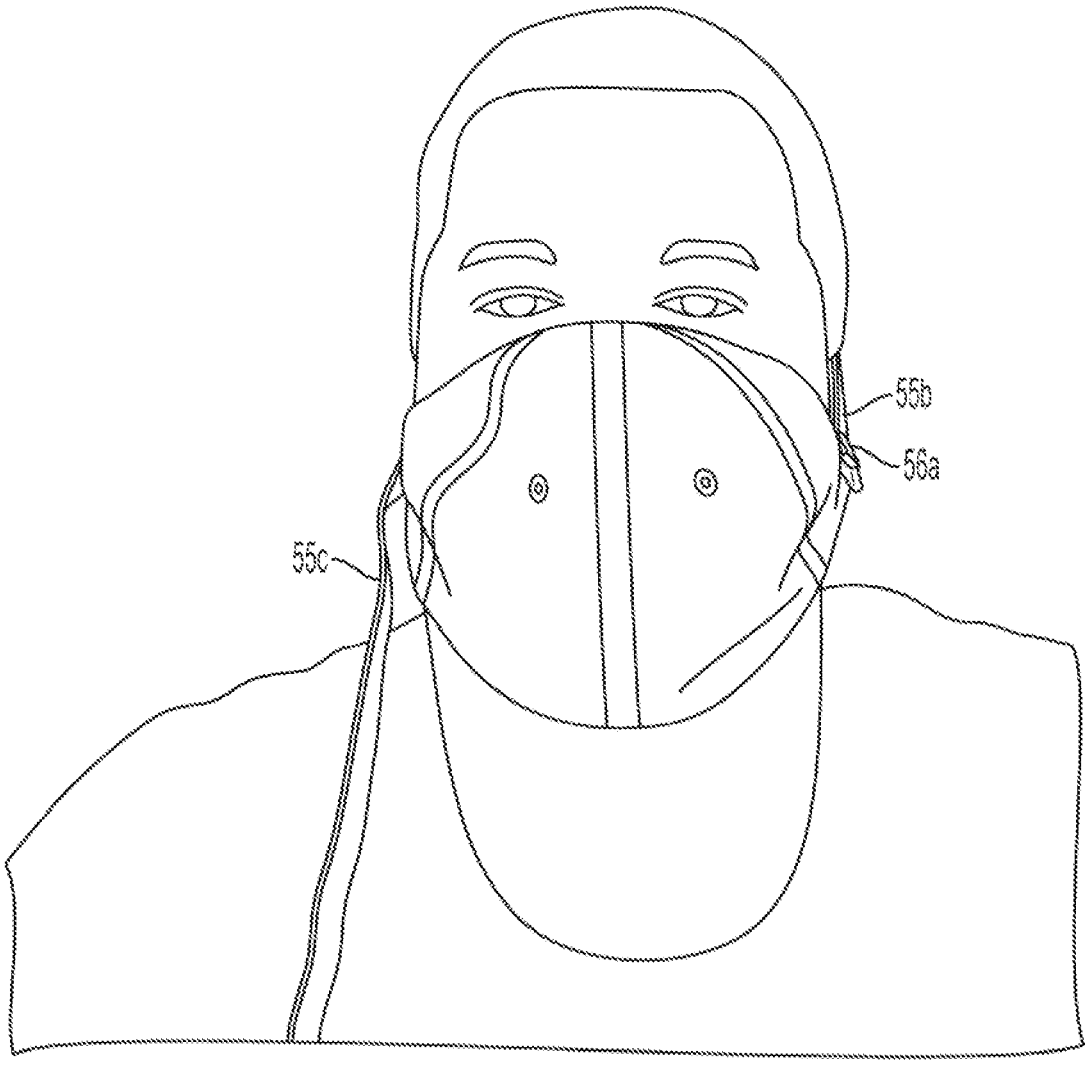
FIGS. 9A-9C are various views of a wearer wearing a headwear article (e.g., cap) in a mask configuration, in which the mask support element of FIGS. 7A-7C is in a use position that supports the headwear article over the face of the wearer.
Figure 9B:
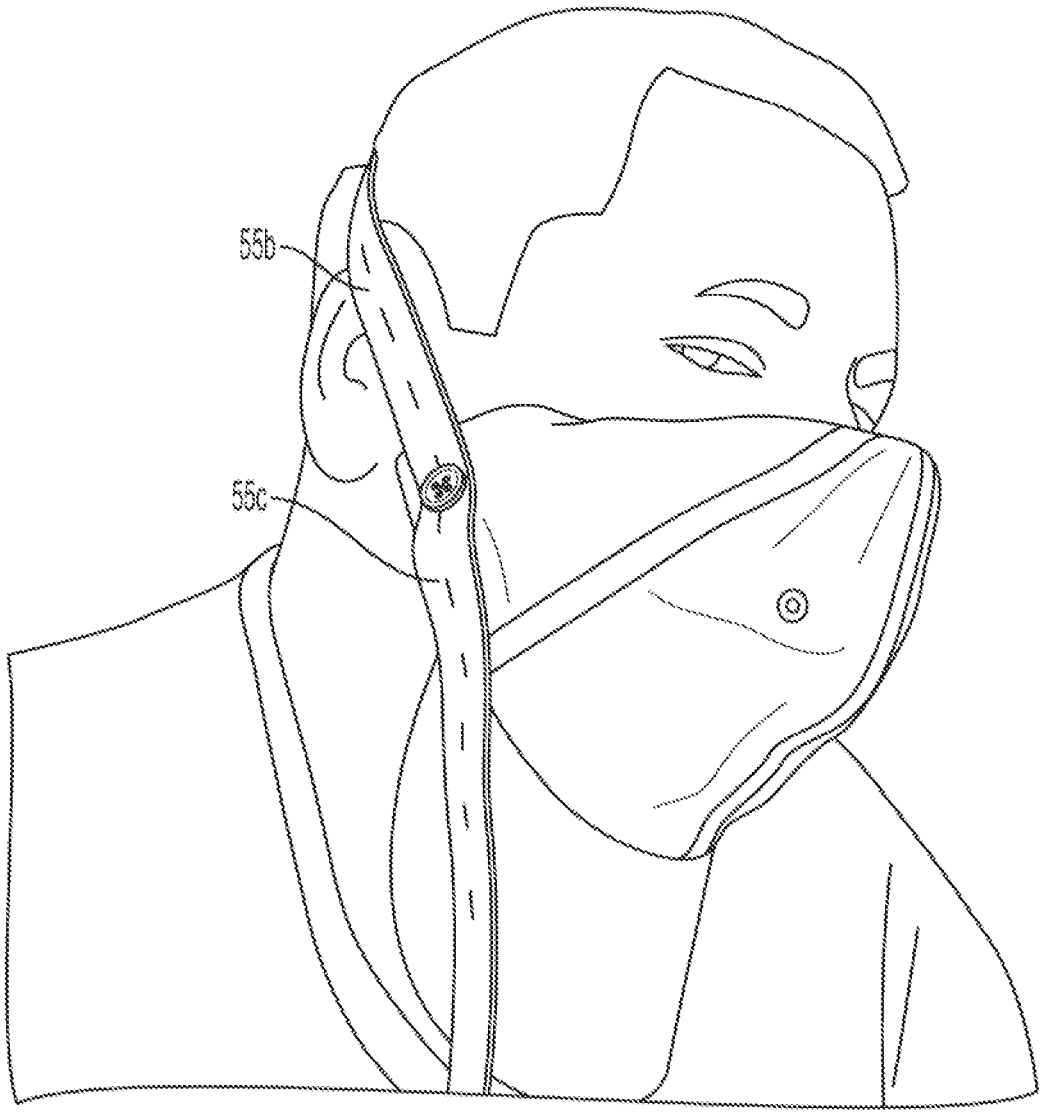
Figure 9C:
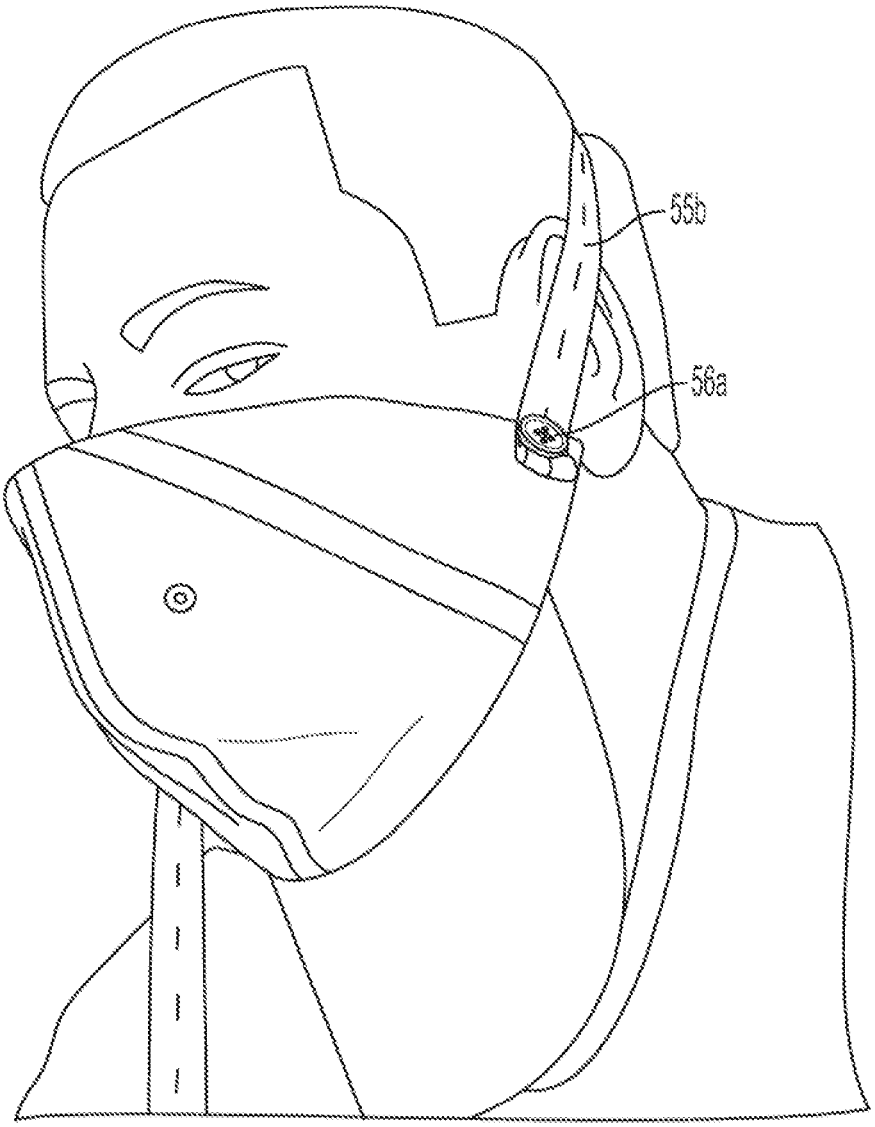

Optionally, in further exemplary aspects, the at least one mask support element 50 can be configured to be selectively moved (by the wearer) about and between a stowed position (FIG. 6) and a use position (FIG. 5). In some aspects, when in the stowed position, the at least one mask support element 50 (e.g., a band or strap) can at least partially rest across or over a portion of the headwear article. For example, in some aspects, and as shown in FIG. 6, when in the stowed position, the at least one mask support element 50 can rest across a portion of the front portion 24 of the crown and/or the visor 31. In these aspects, it is contemplated that the at least one mask support element 50 can be pivotally coupled to the crown, thereby permitting selective pivotal movement about and between the stowed position and a use position in which the at least one mask support element extends behind the head of the wearer. Optionally, in some aspects, from the stowed position, the at least one mask support element 50 can be lifted over the crown portion to reach the use position. During or after movement of the at least one mask support element 50 to the use position, the rear portion 26 of the crown can be displaced into the front portion 24 of the crown. In other aspects, it is contemplated that in the stowed position, the at least one mask support element can rest or be positioned over a portion of the rear portion 26 of the crown. In these aspects, it is contemplated that from the stowed position, the displacement of the rear portion 26 of the crown into the front portion 24 of the crown can place the at least one mask support element 50 in the use position. Optionally, in various aspects, it is contemplated that the crown and/or the visor can comprise a fastener that is configured to retain the at least one mask support element in the stowed position.

An exemplary embodiment of the at least one mask support element 50 is shown in FIGS. 7A-9C. In various aspects, the at least one mask support element 50 can comprise a band 52 (e.g., strap, cord, lanyard, etc.) as further disclosed herein. As shown, the at least one mask support element 50 can further comprise first and second fasteners 56*a*, 56*b* positioned on respective opposing sides of the crown. In exemplary aspects, the first and second fasteners 56*a*, 56*b* can be secured to the crown such that the fasteners are accessible from (and extend outwardly from) the exterior surface of the crown. In exemplary aspects, and as shown in FIG. 7C, it is contemplated that one or more of the first and second fasteners 56*a*, 56*b* can be secured to the crown using stitching 58 that passes through a thickness of the crown from an interior of the crown. Optionally, in these aspects, it is contemplated that the stitching 58, in addition to passing through the crown structure, can pass through at least a portion of a sweatband or other annular structure that forms the inner circumference of the headwear article.

In use, the first and second fasteners 56*a*, 56*b* can be configured to couple to respective portions of the band. Although specific examples of the first and second fasteners 56*a*, 56*b* are described below, it is contemplated that any fastener configuration that is capable of securely coupling a band to a headwear article as disclosed herein can be used. Exemplary fasteners include buttons, hook-and-look fasteners, snaps, stitching, adhesives, clamps, clasps, pins, hooks, combinations thereof, and the like.

Optionally, the band 52 can define a plurality of openings 54 spaced apart along a length of the band. In some aspects, the plurality of openings 54 can be consistently spaced along substantially the entire length of the band. Alternatively, it is contemplated that the plurality of openings can be formed along only a portion(s) of the length of the band. In exemplary aspects, at least one of the first fastener 56*a* or the second fastener 56*b* can comprise a button (or projection) that is configured to be removably received within an opening 54 of the plurality of openings of the band to couple the band to the crown at a selected location along the length of the band. Optionally, in some aspects, it is contemplated that the first fastener 56*a* can permanently secure the band to the crown, while the second fastener 56*b* can be configured for receipt within an opening of the band. In these aspects, it is contemplated that the first fastener 56*a* can comprise stitching or other structure/material that permanently secures the band to a first side of the crown, while the second fastener 56*b* can comprise a button (or projection) or other fastener that non-permanently couples the band to an opposing second side of the crown, thereby permitting adjustment of the fit of the band over or around a portion of the wearer's head.

As shown in FIGS. 7A-9C, in some aspects, the first and second fasteners 56*a*, 56*b* can optionally comprise first and second buttons that are configured to be removably received within respective openings 54 of the plurality of openings of the band to couple the band to the crown at selected locations along the length of the band. In these aspects, it is contemplated that with the band coupled to the crown at both the first and second buttons, the band 52 can have a first portion 55*b* that extends between the first and second buttons, a second portion 55*a* that extends beyond the first button (moving away from first portion 55*b*), and a third portion 55*c* that extends beyond the second button (moving away from first portion 55*b*). It is contemplated that the operative lengths of each of these portions of the band 52 can be selectively adjusted based upon the particular openings of the band through which the respective buttons extend, thereby allowing for modification of the fit when the headwear article is in the mask configuration. In particular, it is contemplated that the operative length of the first portion 55*b* (between the first and second buttons) can determine the amount of material of the band that is available for passage around the back of the head of the wearer (See FIGS. 9A-9C). To adjust the operative length of the first portion 55*b*, the first and/or second buttons can be withdrawn from an opening of the band and passed through a different opening of the band, thereby increasing or reducing the operative length of the first portion (and loosening or tightening the fit). When in the hat configuration, it is contemplated that the band can either be removed from the buttons or pivoted to a stowed configuration in which the first portion 55*b* of the band 52 extends across the crown over the visor (See FIGS. 8A-8C).

Figure 10:
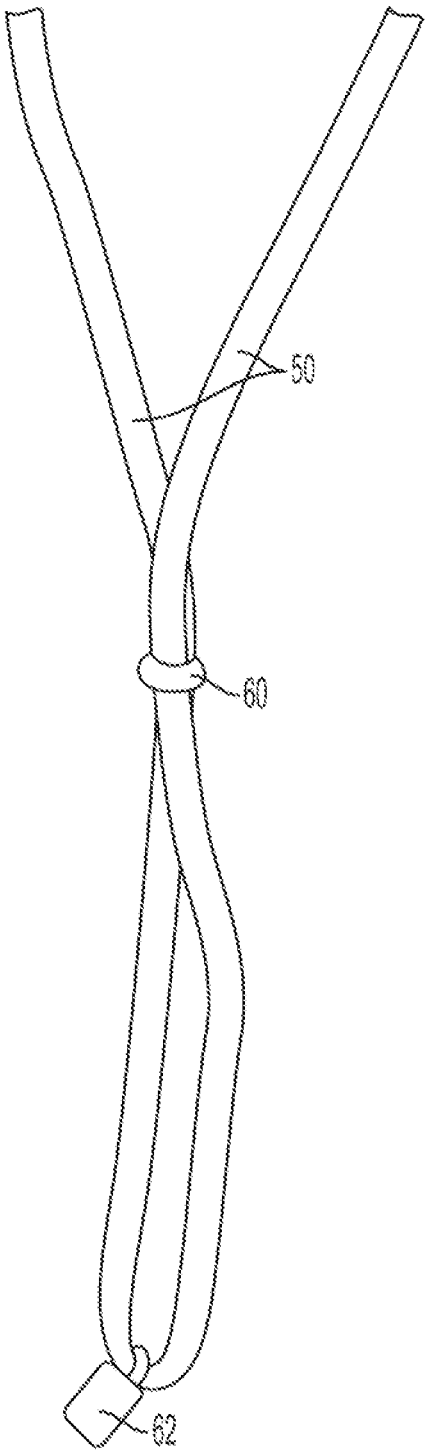
FIG. 10 depicts an exemplary lanyard for use as a mask support element as disclosed herein.

In further exemplary aspects, and as shown in FIG. 10, it is contemplated that the at least one mask support element 50 can comprise a lanyard or lanyard-style strap, band, or cord. In these aspects, it is contemplated that portions of the lanyard can be coupled together by a lock 60 (e.g., a bead, clamp, clip, stopper, or other releasable (optionally, spring-loaded) fastener) that has a central bore, which is configured to simultaneously receive and frictionally engage the portions of the lanyard. In use, it is contemplated that the lock 60 can be released and selectively advanced along the operative length of the lanyard and then reengage the portions of the lanyard, thereby loosening or tightening the fit of the mask over the face of the user. More particularly, it is contemplated that the lock can be advanced toward the head of the wearer to tighten the fit, while the lock can be advanced away from the head of the wearer to loosen the fit. Optionally, it is contemplated that the at least one mask support element 50 can further comprise a stop structure 62 that receives a portion of the lanyard and prevents advancement of the lock 60 beyond the stop structure. It is further contemplated that the stop structure 62 can provide a surface (or surfaces) that can be gripped by the wearer while the lock is advanced toward or away from the head of the wearer. In exemplary aspects, it is contemplated that opposing ends of the lanyard can be secured or coupled to opposing portions of the crown of the headwear article. In some aspects, it is contemplated that the opposing ends of the lanyard can be secured or coupled to opposing portions of the crown in the same manner disclosed herein with respect to other exemplary mask support elements 50. For example, in some aspects, it is contemplated that the opposing ends of the lanyard can comprise respective fasteners that are configured to engage complementary fasteners associated with the opposing portions of the crown of the headwear article. In some aspects, it is contemplated that the lanyard can be permanently associated with the crown of the headwear article, with the lanyard being moveable about and between a stowed position (when the article is in the headwear configuration) and a use position (when the article is in the mask configuration) as disclosed herein. In still other aspects, it is contemplated that the lanyard can permanently associated with the crown and be configured for use in both the headwear and mask configurations. For example, it is contemplated that the lanyard can provide additional support to the headwear article when the article is used in the headwear configuration and permit adjustment of the fit of the article when the article is used in the mask configuration, with the lanyard extending rearwardly of the head of the wearer in both configurations.

Figure 11:
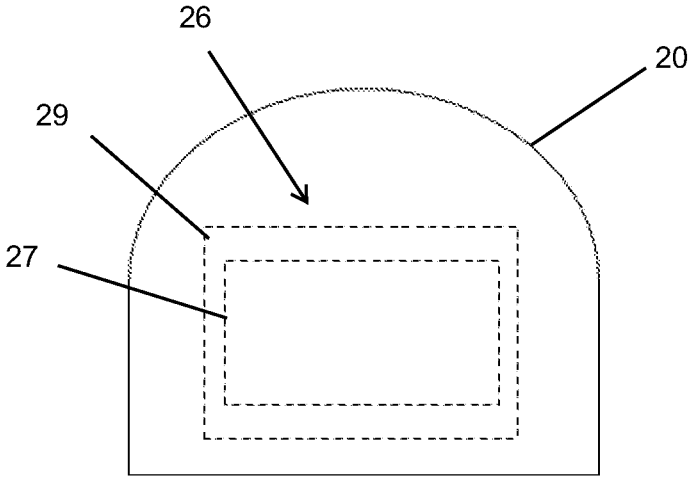
FIG. 11 is a rear view of an exemplary crown having a slot that receives a filter.

In further exemplary aspects, at least a portion of the crown (in particular, at least the rear portion 26 of the crown that contacts portions of the face of the wearer) can comprise antimicrobial material, particularly anti-viral material. In exemplary aspects, it is contemplated that the antimicrobial material can comprise silver, copper, or combinations thereof. In further aspects, and as shown in FIG. 11, it is contemplated that the antimicrobial material can be embodied as a filter 27 that is selectively receivable within a slot 29 that is defined within the interior of the crown.

In still further exemplary aspects, it is contemplated that the crown can have an elastic base that is configured to conform to a circumference of a head of the wearer, thereby providing a secure fit when the headwear article is in the headwear configuration. In these aspects, when the headwear article is in the mask configuration, it is contemplated that the elastic base structure can be manually displaced from the face of the wearer to provide an opening that permits access to the face of the wearer from under the visor. In use, it is contemplated that displacement of the elastic base to form the opening can advantageously permit unobstructed access to the mouth of the wearer for purposes of eating or drinking without the need for completely exposing the face of the wearer.

Additionally, or alternatively, the visor 31 can be pivotally connected to the crown. For example, in the mask configuration, the visor 31 can be configured to pivot from a closed position that restricts access to the face of the wearer from under the visor to an open position that permits access to the face of the wearer from under the visor. Optionally, with reference to FIGS. 3B-3C, it is contemplated that the headwear 10 can comprise a hinge 32 that provides the pivotal connection between the visor and the crown. In further aspects, it is contemplated that the hinge 32 can cooperate with at least one stop or catch structure to permit retention of the visor in the closed or open position unless sufficient force is applied to overcome the retention force. In use, it is contemplated that movement of the visor to the open position can advantageously permit unobstructed access to the mouth of the wearer for purposes of eating or drinking without the need for completely exposing the face of the wearer.

In exemplary aspects, it is contemplated that the headwear articles can be provided in various sizes (e.g., men's, women's, or children's sizes). Additionally, or alternatively, it is contemplated that the headwear article can include an adjustable closure feature as is known in the art for selectively adjusting the operative size/diameter of the headwear article.

In further exemplary aspects, it is contemplated that the headwear articles can be provided in various styles, including for example, and without limitation, a baseball cap-style headwear article, a visor-style headwear article, and the like. Optionally, in these aspects, the headwear articles can be provided with visors of various dimensions.

In still further exemplary aspects, it is contemplated that the headwear articles can comprise logos and/or graphics. Optionally, in some aspects, such logos and/or graphics can be provided on a portion of the crown of the headwear article, such as, for example, on the front portion 24 of the crown.

In still further exemplary aspects, the crown can optionally comprise an internal storage compartment (not shown) for storing sanitized wipes or other disinfecting components or materials.

In use, when the mask configuration of the headwear is no longer needed or desired, the crown can be removed from the face of the wearer. Then, the crown can be expanded from the mask configuration to the headwear configuration, and the crown can be positioned over a portion of the head of the wearer. It is contemplated that the sequential conversion to and from headwear configuration to mask configuration can be repeated as many times as desired, thereby providing a convenient way to carry and keep up with a mask that serves the dual purpose of a headwear article when not in use.

In exemplary aspects, it is contemplated that kits can be provided for converting conventional headwear articles into headwear articles as disclosed herein, which can selectively transition between headwear and mask configurations. For example, such conversion kits can comprise at least one mask support element 50 and at least one fastener (optionally, at least two fasteners) that couples (optionally, permanently secures) the at least one mask support element 50 to the crown of the headwear article. Examples of such fasteners are further disclosed herein and include, for example, and without limitation, a quantity of thread (for sewing), a quantity of adhesive, a snap fastener, hook-and-loop fastener material, a button, a clip, a clamp, a hook, a loop, combinations thereof, or other suitable fasteners that are capable of functioning as disclosed herein. Examples of such mask support elements are further disclosed herein and include, for example, a band, a strap, a lanyard, and the like. Optionally, in some aspects, the fasteners of the kit can comprise at least one fastener configured to be associated with the crown of the headwear article and at least one fastener associated with the at least one mask support element and configured to complementarily engage the fastener(s) associated with the crown. In further aspects, it is contemplated that the disclosed kits can further comprise a manual or pamphlet having instructions for modifying the structure of the headwear article to permit conversion between a headwear configuration and a mask configuration as further disclosed herein. Such manuals or pamphlets can provide instructions concerning the locations for placement of respective fasteners, the methods for securing the respective fasteners to the headwear article, and methods for attaching, removing, and/or adjusting the mask support elements to permit conversion between the headwear and mask configurations and allow for adjustment of fit. In some aspects, it is contemplated that the kits can comprise a plurality of different types, styles, and/or colors of fasteners and/or a plurality of different types, styles, and/or colors of mask support elements to allow the wearer to customize the look and performance of the headwear article.

Although the foregoing invention has been described in some detail by way of illustration and example for purposes of clarity of understanding, certain changes and modifications may be practiced within the scope of the appended claims.

What is claimed is:

1. A method of using an article of headwear, the article of headwear being convertible between a headwear configuration and a mask configuration, the article of headwear comprising:

a crown for covering at least a portion of a head of a wearer, the crown having a rear portion and a front portion that cooperate to define a circumference of the crown;

a visor attached to the front portion of the crown; and a band that extends outwardly from and between opposing sides of the crown, wherein the method comprises:

a) with the article of headwear in the headwear configuration and with the band in a stowed position in which the band rests across a portion of the front portion of the crown or the visor, pivoting the band to a use position in which the band extends over the crown portion and is configured to extend behind the head of the wearer;

b) after or during movement of the band from the stowed position to the use position, collapsing the rear portion of the crown into the front portion of the crown to position the crown in the mask configuration;

c) placing the rear portion of the crown over the face of the wearer; and d) positioning the band around the head of the wearer to secure the crown over the face of the wearer.

2. The method of claim 1, wherein at least a portion of the crown comprises anti-viral material.

3. The method of claim 2, wherein the rear portion of the crown comprises anti-viral material.

4. The method of claim 1, wherein the band forms a continuous loop that extends outwardly from and between opposing sides of the crown.

5. The method of claim 1, further comprising:

a) displacing the crown and/or the visor away from the wearer to permit eating or drinking.

6. The method of claim 1, further comprising:

a) removing the crown from the face of the wearer;

b) expanding the crown from the mask configuration to the headwear configuration; and c) positioning the crown over a portion of the head of the wearer.

7. The method of claim 1, wherein the article of headwear is a cap.

8. The method of claim 1, wherein the band comprises elastic material.

9. The method of claim 1, wherein in the mask configuration, the crown and/or the visor is selectively displaceable from a closed position that restricts access to the face of the wearer from under the visor to an open position that permits access to the face of the wearer from under the visor.

10. The method of claim 9, wherein the visor pivots from the closed position to the open position.

11. The method of claim 10, wherein a hinge pivotally connects the visor to the crown.

12. The method of claim 1, wherein the rear portion of the crown defines a slot that receives a filter, and wherein the filter comprises the anti-viral material.

* * * * *